US005933802A

United States Patent [19]

Emori

[11] Patent Number: 5,933,802

[45] Date of Patent: Aug. 3, 1999

[54] SPEECH REPRODUCING SYSTEM WITH EFFICIENT SPEECH-RATE CONVERTER

[75] Inventor: Tadashi Emori, Tokyo, Japan

[73] Assignee: NEC Corporation, Tokyo, Japan

[21] Appl. No.: 08/872,438

[22] Filed: Jun. 10, 1997

[30] Foreign Application Priority Data

Jun. 10, 1996 [JP] Japan ..... 8-147133

[51] Int. Cl.[6] ..... G10L 9/00

[52] U.S. Cl. ..... 704/219; 704/207

[58] Field of Search ..... 704/207, 219, 704/220, 221, 222, 223, 229, 230

[56] References Cited

U.S. PATENT DOCUMENTS

| | | | |
|---|---|---|---|
| 5,657,420 | 8/1997 | Jacobs et al. | 704/221 |
| 5,717,823 | 2/1998 | Kleijn | 704/220 |
| 5,751,903 | 5/1998 | Swaminathan et al. | 704/220 |

OTHER PUBLICATIONS

Kazunori Ozawa, et al., "M–LCELP Speech Coding at 4 kb/s with Multi–Mode and Multi–Codebook", *IEICE Trans. Commun.,* vol. E77–B. No. 9, (Sep. 1994), pp. 1114–1121.

David Malah, "Time–Domain Algorithms for Harmonic Bandwidth Reduction and Time Scaling of Speech Signals", *IEEE Transactions On Acoustics, Speech, and Signal Processing,* vol. ASSP–27, No. 2, (Apr. 1979), pp. 121–133.

*Primary Examiner*—David R. Hudspeth
*Assistant Examiner*—Susan Wieland
*Attorney, Agent, or Firm*—Scully, Scott, Murphy & Presser

[57] ABSTRACT

In a speech reproducing system, a speech coder receives an input speech signal to output a speech coded information including a pitch information of the input speech signal and a mode information indicative of a short-time characteristics of the input speech signal, and a speech decoder receives and decodes the speech coded information to generate a decoded speech signal. A speech-rate converter receives the pitch information and the mode information included in the speech coded information and the decoded speech signal, to convert the speech-rate of the decoded speech signal by using the pitch information and the mode information, thereby to generate an output speech signal.

3 Claims, 6 Drawing Sheets

SPEECH REPRODUCING SYSTEM WITH EFFICIENT SPEECH-RATE CONVERTER

BACKGROUND OF THE INVENTION

1. Field of the Invention

The present invention relates to a speech reproducing system configured to decode a speech coded information which is outputted from a speech coder by coding an input speech signal and which includes a pitch information and a mode information which is a short-time characteristics of the speech, obtained by analyzing the input speech signal, and furthermore to convert a speech-rate of a decoded speech signal, so as to generate an output speech signal. More specifically, the present invention relates to a speech reproducing system capable of reducing the amount of computation and of minimizing deterioration of the speech quality in reproducing a speech signal outputted after coding and decoding, as in an automatic answering telephone set having a solid state recording-reproducing device, by modifying only the speech-rate without changing the pitch (or frequency) of the speech or the timbre of the speech 2. Description of Related Art In the prior art, a technology of coding a speech signal to compress the amount of data is widely utilized in order to realize an efficient transmission and an efficient storage.

For example, as the speech coding system capable of obtaining a high compression ratio, a CELP (Code Excited Linear Prediction) system can be exemplified, which is disclosed in detail by, for example, Ozawa, "Speech Coding Technology" included in the Japanese language book "Mobile Communication Digitizing Technology", which is called a "Reference 1" in this specification and the content of which is incorporated by reference in its entirety into this application.

In brief, in this CELP scheme, an input speech signal is coded by obtaining information of a spectrum component of the input speech signal in accordance with a linear predictive analysis, and by vector-quantizing information of a sound source signal by use of an adaptive codebook and a source source codebook. In a decoding, a LPC (Linear Predictive Coding) filter obtained by the linear predictive analysis, is excited in accordance with a quantized vector obtained from an adaptive codebook and a source codebook, so that a speech signal is obtained. In the vector-quantization based on the adaptive codebook, there is obtained a delay information which is a period of a repetitive component in the speech, and the quantized vector is described using the adaptive code vector which is the repetitive component having the period of the delayed information. Thus, a quantizing efficiency is elevated.

In addition, an M-LCELP (Multirnode-Learned CELP) system is disclosed by Ozawa et al, "4 kbps high quality M-LCELP speech coding", NEC Technical Disclosure Bulletin, Vol. 48, No. 6, which is called a "Reference 2" in this specification and the content of which is incorporated by reference in its entirety into this application. In this system, mode information expressed by no sound or a no-sound portion, a transient portion, a weak steady portion of a voiced sound, or a steady portion of the voiced sound, is determined by using a basic period of the speed or the like, and the adaptive codebook or the sound source codebook is switched over for each one of the modes.

Now, an example of the speech coder of the M-LCELP scheme will be described with reference to FIG. 1, which is a block diagram illustrating a fundamental principle of the speech coder of the M-LCELP scheme.

The speech coder generally designated with Reference Numeral 10, includes a linear predictive analyzer 11 receiving an input speech signal Vin to conduct a linear predictive analysis for the input speech signal Vin for each frame having a constant time length, so that a linear predictive coding LPC is obtained. The speech coder 10 also includes a mode discriminator 12 receiving the input speech signal Vin to determine, on the basis of the strength of a basic period of the speech in the frame, a speech mode information M indicative of no sound or a no-sound portion, a transient portion, a weak steady portion of a voiced sound or a steady portion of the voiced sound.

An adaptive codebook retrieval unit 13 receives the input speech signal Vin, the linear predictive coding LPC and the mode information M, and generates a delay information AC indicative of a repetitive component of the speech. A sound codebook retrieval unit 14 receives the input speech signal Vin, the linear predictive coding LPC, the mode information M and the delay information AC, and refers to a sound source codebook 41, to output a sound source code EC which is a sound source information.

A signal output unit 15 receives the linear predictive coding LPC, the mode information M, the delay information AC, and the sound source code EC, and outputs a speech coded information IDX having a predetermined format including the linear predictive coding LPC, the mode information M, the delay information AC, and the sound source code EC.

Now, an example of the speech decoder of the M-LCELP scheme will be described with reference to FIG. 2, which is a block diagram illustrating a fundamental principle of the speech decoder of the M-LCELP scheme.

In the speech decoder generally designated with Reference Numeral 20, a signal input unit 21 receives the speech coded information IDX and outputs the linear predictive coding LPC, the mode information M, the delay information AC, and the sound source code EC.

An adaptive codebook decoder 22 receives the mode information M and the delay information AC, to decode and reproduce an adaptive code vector. A sound source codebook decoder 23 receives the mode information M and the sound source code EC to decode and reproduce the sound source information with reference to a sound source codebook 42.

An adder 24 receives the adaptive code vector decoded by the adaptive codebook decoder 22 and the sound source information decoded by the sound source codebook decoder 23, and generates an added signal S, which is supplied to a synthesizing filter 25 which also receives the linear predictive coding LPC from the signal input unit 21. The synthesizing filter 25 generates a decoded speech signal VDEC.

On the other hand, a speech-rate converting technology for reproducing a speech when the same speaker spoke quickly or slowly, without changing the pitch (or frequency) of the speech or the timbre of the speech, is used in a video tape recorder, a hearing aid, or an automatic answering telephone set.

As regards this speech-rate converting technology, various applications were proposed by Kato, "Speech-rate Converting Technology entered into Actual Use Stage, to Fundamental Function of Speech Output Instruments", Nikkei Electronics, No. 622, November 1994 (which is called a "Reference 3" in this specification and the content of which is incorporated by reference in its entirety into this application).

Many speech-rate converting systems used in these applications are based on a TDHS (Time Domain Harmonic Scaling) scheme. This TDHS scheme is configured to slice the speech signal for each pitch and to make a window processing, and then to superpose the sliced signals, as shown by, for example, Furui, "Digital Speech Processing" published from Tokai University Publishing Company in 1985 (which is called a "Reference 4" in this specification and the content of which is incorporated by reference in its entirety into this application).

Now, the TDHS scheme will be described with reference to FIGS. 3A and 3B.

FIG. 3A illustrates the TDHS processing for multiplying the input speech signal by ½. As shown in FIG. 3A, the input speech signal is sliced out in units of two pitches, and a window function processing is conducted, and thereafter, the sliced two pitches of speech signal thus processed are superposed to generate an output speech signal. After this series of processings are completed, next two pitches of speech signal are supplied, and the above mentioned TDHS processing is conducted again.

Thus, since each two pitches of the speech signal is outputted as one pitch of speech signal, the length of the signal is shortened to one half.

FIG. 3B illustrates the TDHS processing for multiplying the input speech signal by 2. As shown in FIG. 3B, the input speech signal is sliced out in units of two pitches, and one pitch of two pitches of speech signal thus obtained is outputted as it is. On the other hand, a window function processing is conducted for the sliced two pitches of speech signal, and thereafter, the sliced two pitches of speech signal thus processed are superposed to generate an output speech signal, which is coupled to the first one pitch of speech signal. After this series of processings are completed, a next one pitch of speech signal is supplied, and the above mentioned TDHS processing is conducted again.

Thus, since each two pitches of the speech signal is outputted as four pitches of speech signal, the length of the signal is elongated to two times.

Next, a prior art speech-rate converter will be described with reference to FIG. 4, which is a block diagram of the speech-rate converter disclosed by Japanese Patent Application Pre-examination Publication No. JP-A-1-093795, (which is called a "Reference 5" in this specification and the content of which is incorporated by reference in its entirety into this application, and an English abstract of JP-A-1-093795 is available from the Japanese Patent Office, and the content of the English abstract of JP-A-1-093795 is also incorporated by reference in its entirety into this application).

The speech-rate converter shown is generally designated by Reference Numeral 300, and includes a waveform editor 32, a pitch extractor 33 and a speech short-tine characteristics discriminator 34.

The pitch extractor 33 receives an input speech signal VDEC and obtains a pitch information T by use of an autocorrelation method. The speech short-time characteristics discriminator 34 receives the input speech signal VDEC, and executes at least one of a discrimination as to whether or not a speech power exists, a PARCOR (Partial Autocorreltion) analysis, and a zero-crossing analysis, and discriminates in which of a vowel period, a voiced consonant period, a voiceless consonant period, a no-sound period the input speech signal VDEC is, so that the speech short-time characteristics information SP is outputted.

The waveform editor 32 receives the input speech signal VDEC, the pitch information T and the speech short-time characteristics information SP, and conducts the speech-rate converting processing as disclosed in "Reference 5" for the input speech signal VDEC, on the basis of the pitch information T and the speech short-time characteristics information SP. Namely, a thinning-out processing and a repeating processing of the waveform is conducted. Thus, an output speech signal VOUT is generated.

The prior art speech reproducing system is constructed to code the speech, to store the coded speech, to decode the stored coded speech, and thereafter to conduct the speech-rate conversion, for the purpose of reproducing the speech, as in the automatic answering telephone set having a solid state recording-reproducing device.

Now, the prior art speech reproducing system will be described with reference to FIGS. 1, 2 and 4 and also with reference to FIG. 5, which is a block diagram illustrating the speech reproducing system obtained by combining the speech coder 10, the speech decoder 20 and the speech-rate converter 300.

As described with reference to FIG. 1, the speech coder 10 codes and compresses the input speech signal Vin by use of the M-LCELP scheme, to output the speech coded information IDX, which can be stored in a memory (not shown) or the like. As described with reference to FIG. 2, the speech decoder 20 decodes the speech coded information IDX (which can be read out from the memory (not shown)) by use of the M-LCELP scheme, to output the decoded speech signal VDEC. As described with reference to FIG. 4, the speech-rate converter 300 conducts the speech-rate converting processing to the decoded speech signal VDEC, to generate the output speech signal VOUT.

The above mentioned prior art speech reproducing system includes the speech-rate converter which receives the decoded speech signal obtained by decoding the coded signal which is obtained by coding the speech signal by use of the M-LCELP scheme, and which executes the speech-rate converting processing to the received decoded speech signal in accordance with the TDHS scheme. In this speech-rate converter, as mentioned above, the pitch extractor 33 obtains the pitch information T by use of the autocorrelation method or another. The speech short-time characteristics discriminator executes the discrimination as to whether or not a speech power exists, the PARCOR analysis, and the zero-crossing analysis, to generate the speech short-time characteristics information.

In this arrangement, however, the amount of computation conducted in the pitch extractor for obtaining the pitch information and the amount of computation conducted in the speech short-time characteristics discriminator for obtaining the speech short-time characteristics information, are generally large, and therefore, a large amount of program and a large amount of processing time are required. This is disadvantageous.

In addition, there is possibility that the speech based on the decoded speech signal processed by the M-LCELP scheme is deteriorated in comparison with an original speech. If it is deteriorated, an effective pitch information and an effective speech short-time characteristics information required for the speech-rate converting processing, may not be obtained, resulting in high possibility that the output speech signal has a sound quality deteriorated in comparison with an original speech.

SUMMARY OF THE INVENTION

Accordingly, it is an object of the present invention to provide a speech reproducing system which has overcome the above mentioned defect of the conventional one.

Another object of the present invention is to provide a speech reproducing system capable of minimizing the amount of computation and the deterioration of the speech quality in a process of reproducing a speech signal, by a speech-rate converting processing which modifies only the speech-rate of the decoded speech signal obtained after coding and decoding, without changing the pitch (or frequency) of the speech or the timbre of the speech.

The above and other objects of the present invention are achieved in accordance with the present invention by a speech reproducing system comprising a speech coder receiving an input speech signal to output a speech coded information including a pitch information of the input speech signal and a mode information indicative of a short-time characteristics of the input speech signal, a speech decoder receiving and decoding the speech coded information to generate a decoded speech signal, and a speech-rate converter receiving the decoded speech signal and at least one of the pitch information and the mode information included in the speech coded information, to convert the speech-rate of the decoded speech signal, thereby to generate an output speech signal.

With this arrangement, in the speech-rate converter, it is possible to make unnecessary at least one or both of a means for extracting the pitch information and a means for generating the short-time characteristics information, which require a large amount of computation and which are a cause for deteriorating the sound quality.

The above and other objects, features and advantages of the present invention will be apparent from the following description of preferred embodiments of the invention with reference to the accompanying drawings.

DESCRIPTION OF THE PREFERRED EMBODIMENTS

Figure 4:
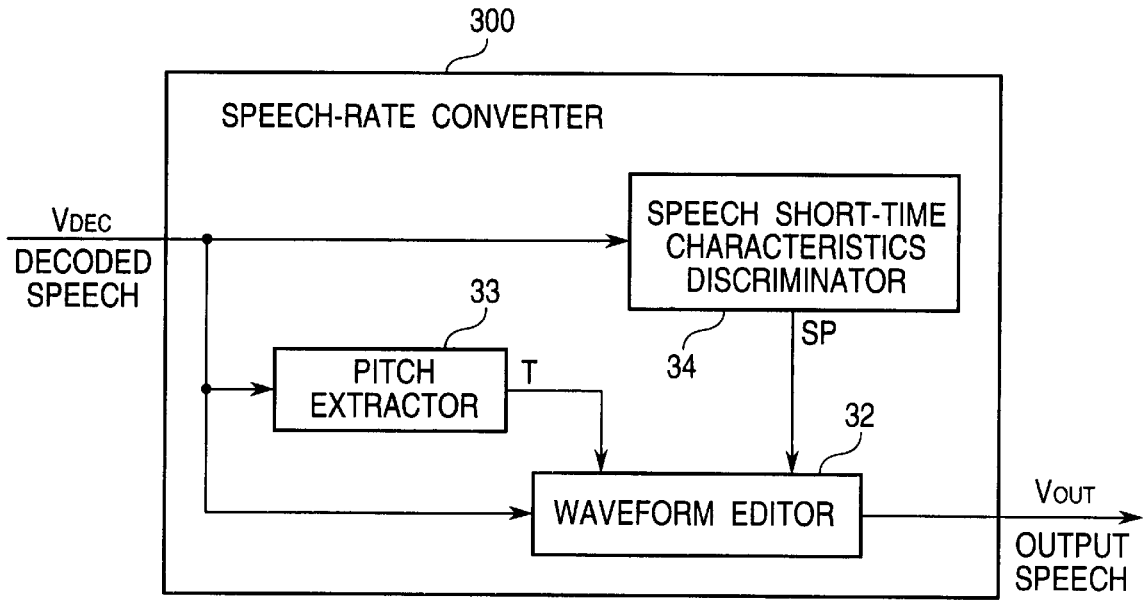
Fig. 4 PRIOR ART
FIG. 4 is a block diagram of the prior art speech-rate converter.
Figure 5:
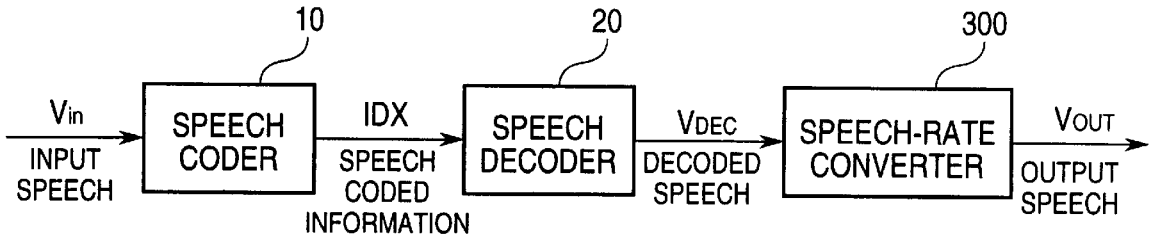
Fig. 5 PRIOR ART
FIG. 5 is a block diagram illustrating the prior art speech reproducing system constituted of the speech coder shown in FIG. 1, the speech decoder shown in FIG. 2, and the speech-rate converter shown in FIG. 4.
Figure 6:
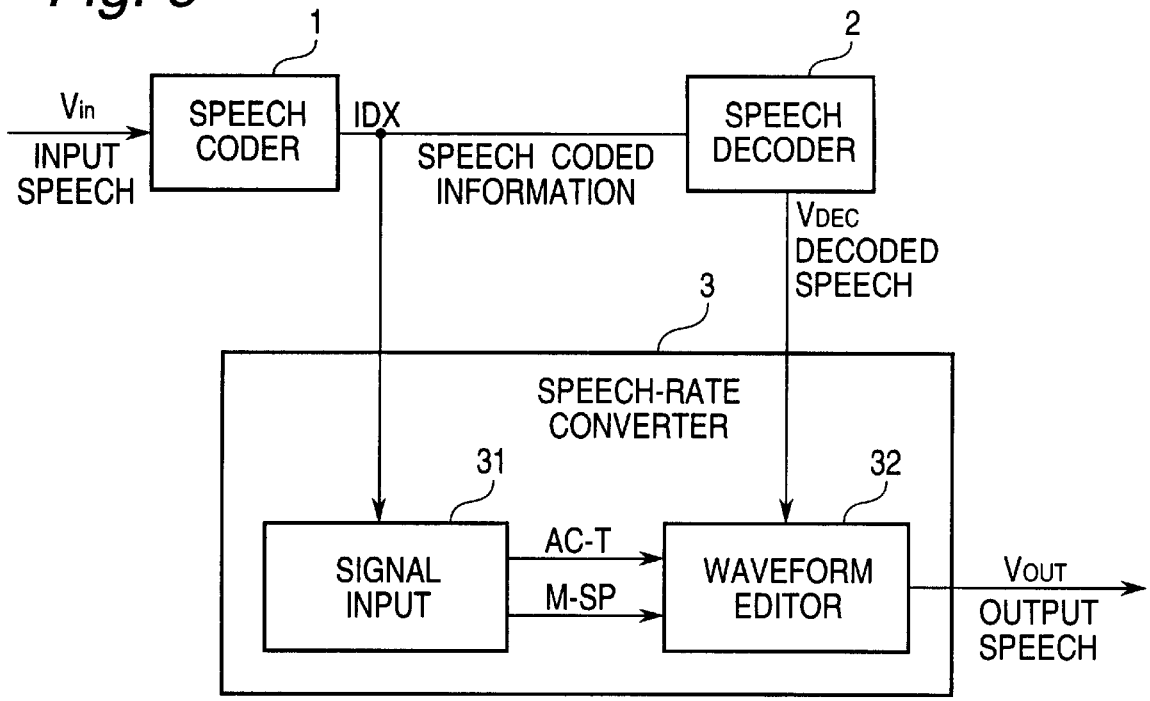
FIG. 6 is a block diagram illustrating a first embodiment of the speech reproducing system in accordance with the present invention.

Referring to FIG. 6, there is shown a block diagram illustrating a first embodiment of the speech reproducing system in accordance with the present invention. In FIG. 6, elements similar to those shown in FIG. 4 are given the same Reference Numerals, and explanation thereof will be omitted for simplification of the description.

Figure 1:
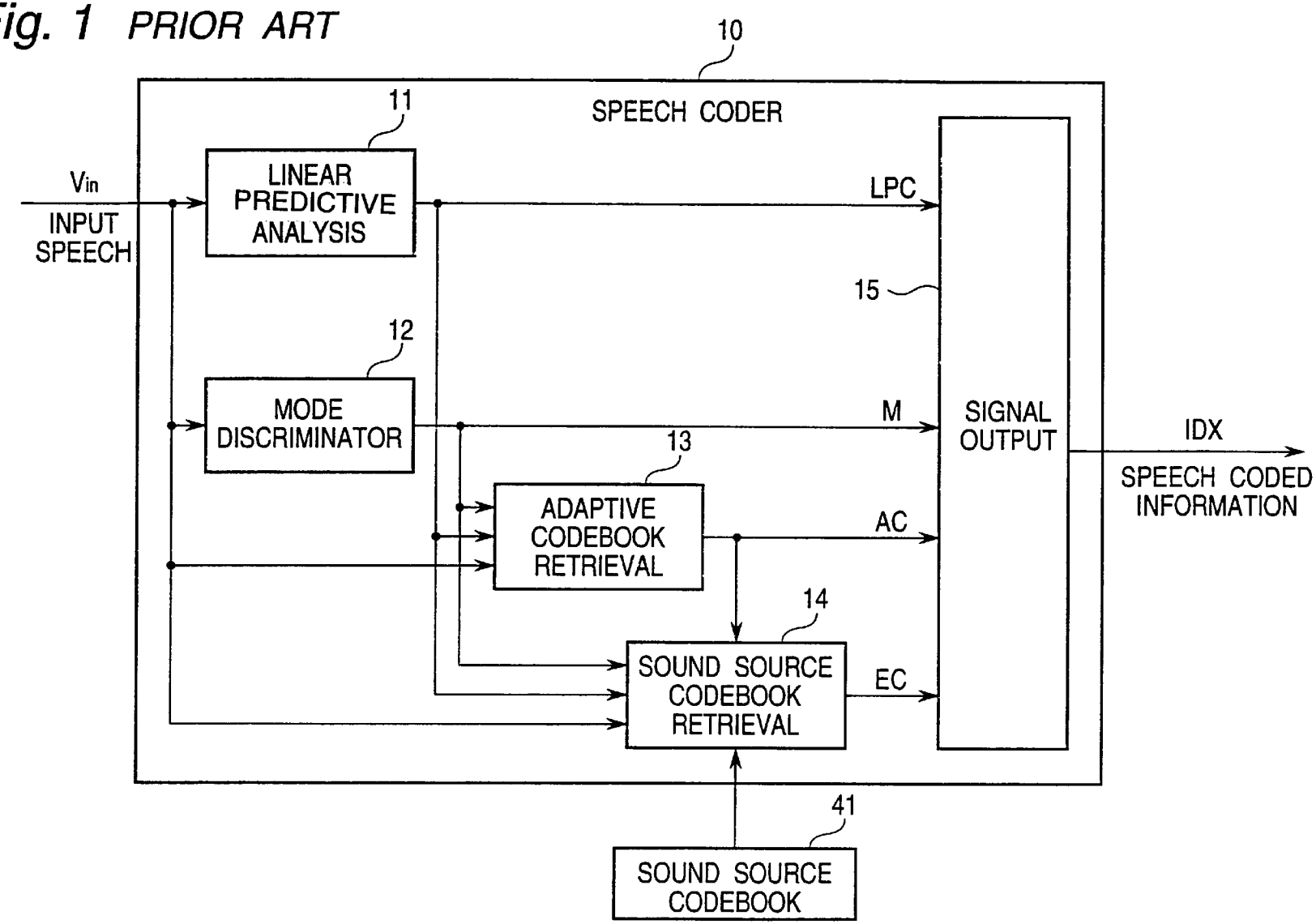
Fig. 1 PRIOR ART
FIG. 1 is a block diagram illustrating a fundamental principle of the speech coder of the M-LCELP scheme.
Figure 2:
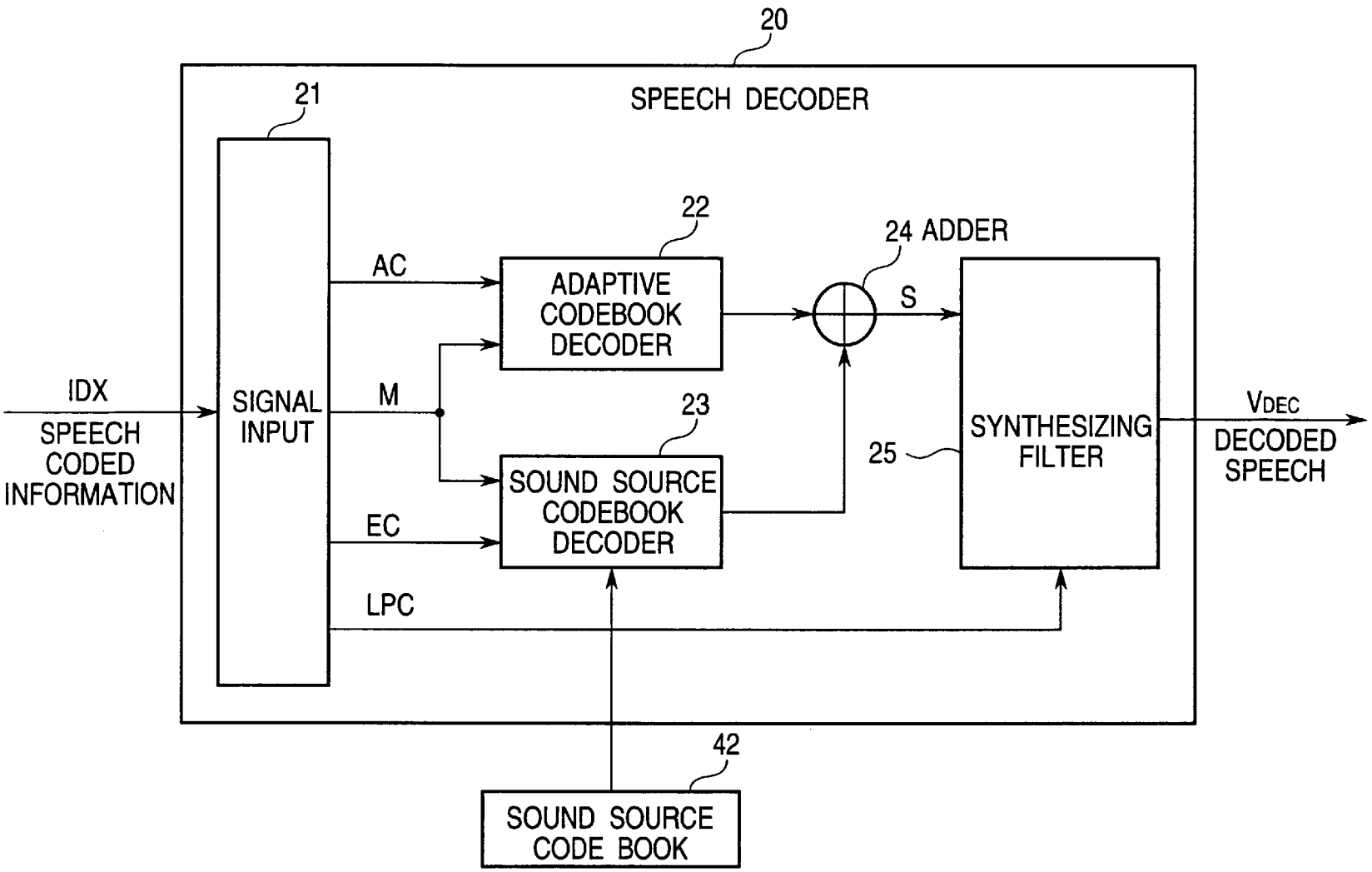
Fig. 2 PRIOR ART
FIG. 2 is a block diagram illustrating a fundamental principle of the speech decoder of the M-LCELP scheme.
Figure 3A:
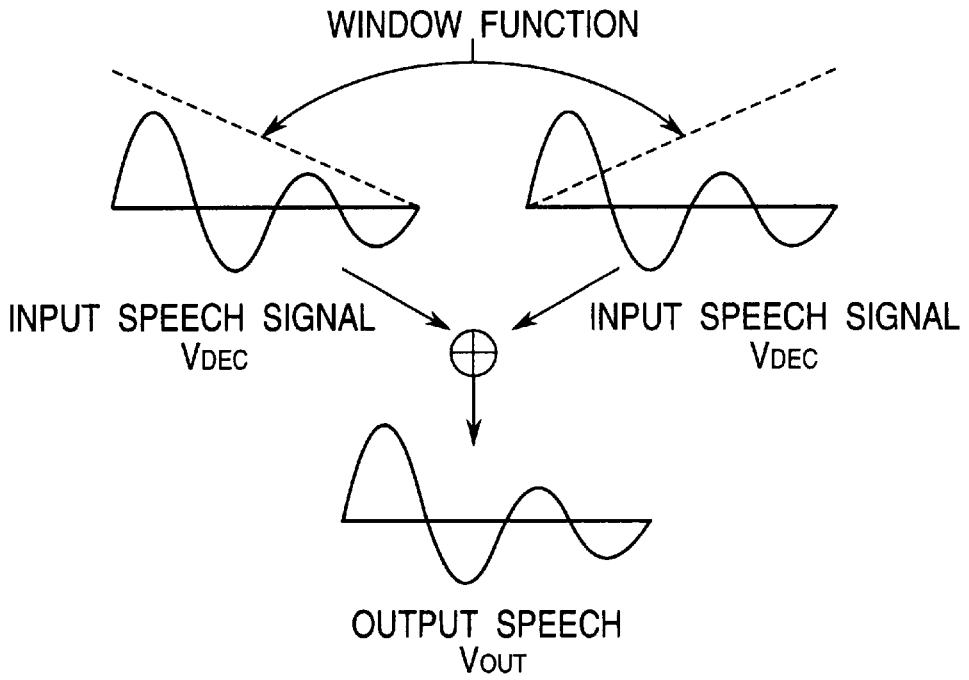
Fig. 3A PRIOR ART
FIGS. 3A and 3B illustrate two different TDHS processings.
Figure 3B:
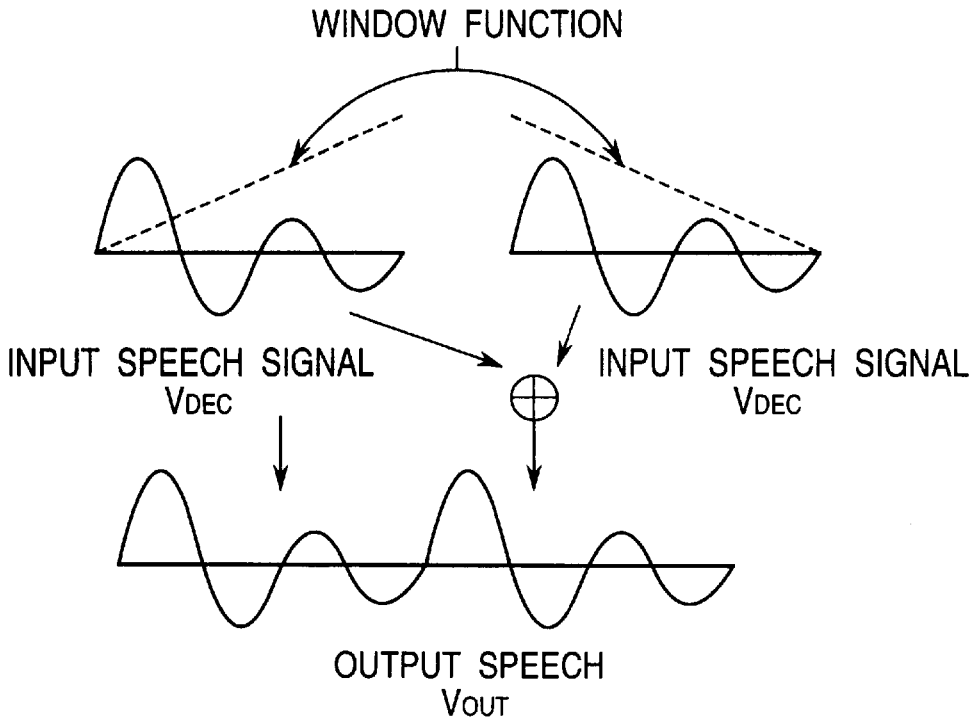
Fig. 3B PRIOR ART

The shown first embodiment includes a speech coder 1 which is the same as the speech coder 10 shown in FIG. 1, a speech decoder 2 which is the same as the speech coder 20 shown in FIG. 2, and a speech-rate converter 3. Therefore, explanation of the speech coder 1 and the speech decoder 2 will be omitted for simplification of the description.

The speech-rate converter 3 includes a signal input unit 31 receiving the speech coded information IDX from the speech coder 1 and extracts the delay information AC and the mode information M from the speech coded information IDX to supply the delay information AC and the mode information M to a waveform editor 32. This waveform editor 32 also receives the decoded speech signal VDEC to conduct the speech-rate converting processing to the decoded speech signal VDEC on the basis of the delay information AC and the mode information M supplied from the signal input unit 31.

As mentioned hereinbefore, the speech coded information IDX is transmitted in a predetermined format including the delay information AC and the mode information M. Therefore, the signal input unit 31 can directly extract the delay information AC and the mode information M from the speech coded information IDX, and accordingly, a special arithmetic and logic operation for obtaining the delay information AC and the mode information M is not required in the speech-rate converter 3.

In addition, in the M-LCELP scheme, when the speech signal is coded, the delay information AC obtained by the adaptive codebook retrieval unit is the repetitive component of the speech as mentioned hereinbefore with reference to FIG. 1. Therefore, the delay information AC can be fundamentally used as the pitch information. On the other hand, the mode information M obtained in the mode discriminator indicates any of no sound or a no-sound portion, a transient portion, a weak steady portion of a voiced sound, and a steady portion of a voiced sound, and is determined by the intensity of the basic period of the speech in each frame. Therefore, the mode information M can be considered to correspond to the speech short-time characteristics information SP.

Namely, as explained in detail in "Reference 2" and "Reference 5" quoted hereinbefore and as can be seen from the descriptions made hereinbefore with reference to FIG. 1 and FIG. 4, the weak steady portion of the voiced sound and the steady portion of the voiced sound in the mode information can be deemed to correspond to a vowel period in the speech short-time characteristics, and the transient portion in the mode information can be deemed to correspond to a voiced consonant period in the speech short-time characteristics. Furthermore, the no-sound portion in the mode information can be deemed to correspond to a voiceless consonant period in the speech short-time characteristics.

Accordingly, since the speech coded information IDX outputted from the speech coder 1 is supplied as the input speech signal Vin, and on the other hand, since the speech coded information IDX is decoded to a decoded speech signal VDEC by the speech decoder 2, when the speech-rate converting processing is conducted to the decoded speech signal VDEC, if the delay information AC included in the speech coded information IDX outputted from the speech coder 1 is used as the pitch information, the speech-rate converter 3 is no longer required to newly calculate the pitch information by the autocorrelation method.

In addition, if the switching-over of the speech signal processing in the speech-rate converting processing is carried out by using the mode information M included in the speech coded information IDX, a processing means such as the speech short-time characteristics discriminator 34 as shown in FIG. 4 for obtaining the speech short-time characteristics, is no longer necessary.

Furthermore, since the delay information AC and the mode information M are obtained by processing an input speech signal Vin which has not yet been subjected to the coding processing and the decoding processing, it is possible to obtain the output speech signal which is more precise than the case in which the pitch information and the speech short-time characteristics are obtained by processing the decoded speech signal VDEC after the coding processing and the decoding processing. Therefore, if both the delay information AC and the mode information M included in the speech coded information IDX are used in the speech-rate converter 3, the speech-rate converting processing can be conducted to the decoded speech signal VDEC while minimizing the necessary amount of computation and the deterioration of the sound quality.

In the above explanation, both the delay information AC and the mode information M have been utilized in order to minimize the necessary amount of computation and the deterioration of the sound quality. However, even if only one the delay information AC and the mode information M is utilized, it is possible to reduce the necessary amount of computation and the deterioration of the sound quality, in comparison with the prior art example, as will be described hereinafter.

Figure 9:
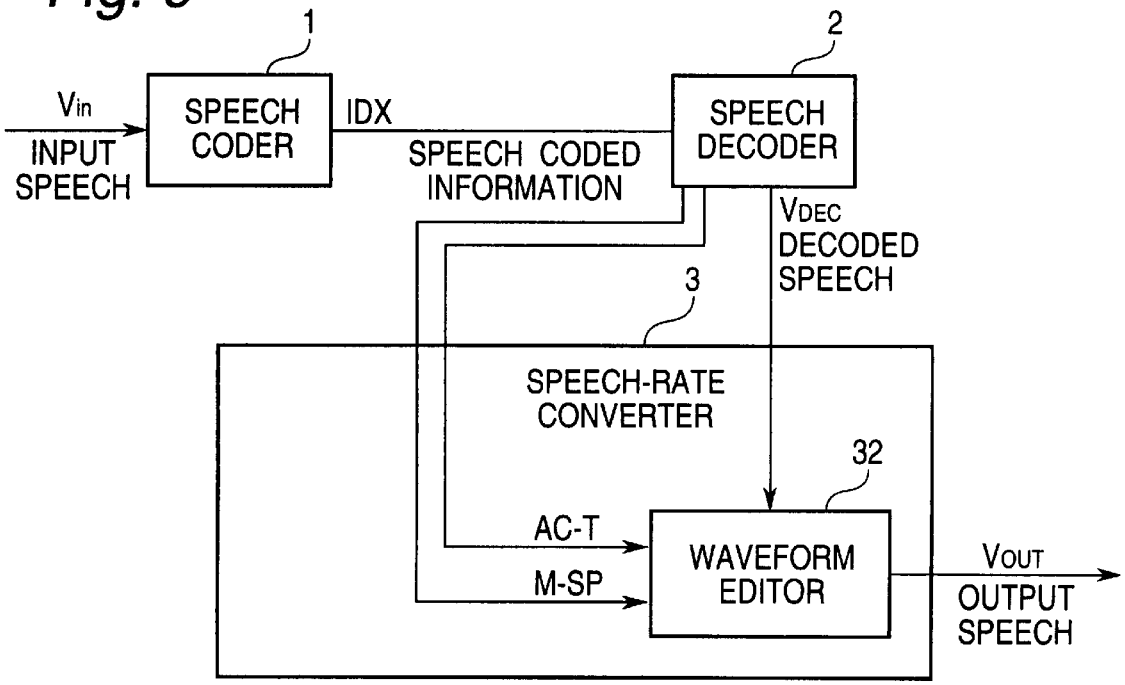
FIG. 9 is a block diagram illustrating a modification of the first embodiment of the speech reproducing system.

In the above embodiment, the signal input unit 31 is provided in the speech-rate converter 3 to extract the delay information AC and the mode information M from the speech coded information IDX. However, if the speech-rate converter is located adjacent to the speech decoder, the speech-rate converter 3 can be connected to directly fetch the output of the signal input unit of the speech decoder. In this case, since the speech-rate converter is no longer required to receive the speech coded information IDX, and therefore, since the signal input unit 31 becomes unnecessary, the speech-rate converter is so modified that, as shown in FIG. 9, the signal input unit 31 is omitted, and the waveform editor 32 receives the delay information AC and the mode information M directly from the speech decoder 2, more specifically, directly from the signal input unit 21 (in FIG. 2) of the speech decoder.

Incidentally, as can be well understood to persons skilled in the art, the speech coding and decoding scheme is not necessarily limited to the M-LCELP scheme, and any other speech coding-decoding scheme such as a multipulse scheme, can be used if it can generate the speech coded information including information corresponding to the pitch information or the mode information. In addition, the present invention can be applied to any other speech-rate converting scheme, if it utilizes information corresponding to the pitch information or the mode information. Furthermore, the speech short-time characteristic information or the mode information can be classified in various manners, for example, into a voiceless sound and a voiced sound, dependently upon applications.

Figure 7:
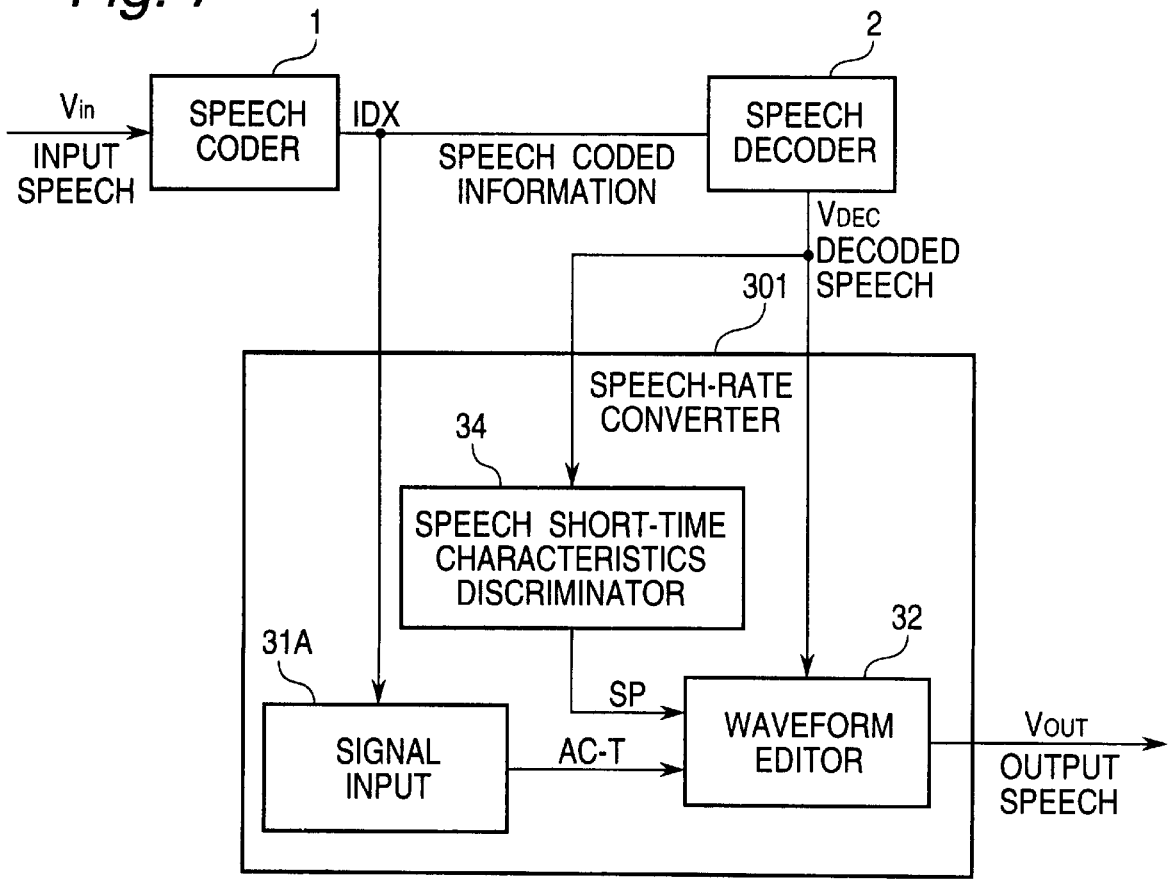
FIG. 7 is a block diagram illustrating a second embodiment of the speech reproducing system in accordance with the present invention.

Now, a second embodiment of the speech reproducing system in accordance with the present invention will be described with reference to FIG. 7. In FIG. 7, elements similar to those shown in FIGS. 4 and 6 are given the same Reference Numerals, and therefore, explanation thereof will be omitted for simplification of the description.

The shown second embodiment includes the speech coder 1 which is the same as the speech coder 10 shown in FIG. 1, the speech decoder 2 which is the same as the speech coder 20 shown in FIG. 2, and a speech-rate converter 301.

The speech-rate converter 301 includes a signal input unit 31A, the waveform editor 32 and a speech short-time characteristics discriminator 34. The signal input unit 31A receives the speech coded information IDX from the speech coder 1 and extracts the delay information AC from the speech coded information IDX to supply the delay information AC as the pitch information T to the waveform editor 32. The waveform editor 32 and the speech short-time characteristics discriminator 34 are the same as those shown in FIG. 4, and therefore, explanation thereof will be omitted for simplification of the description.

In this second embodiment, the speech-rate converter 301 includes the signal input unit 31A, in place of the pitch extractor 33 shown in FIG. 4, and the signal input unit 31A supplies the delay information AC to the waveform editor 32, in place of the pitch information T. Therefore, the second embodiment can reduce the amount of computation and the deterioration of the precision by the amount corresponding to the pitch extractor 33 shown in FIG. 4.

Figure 8:
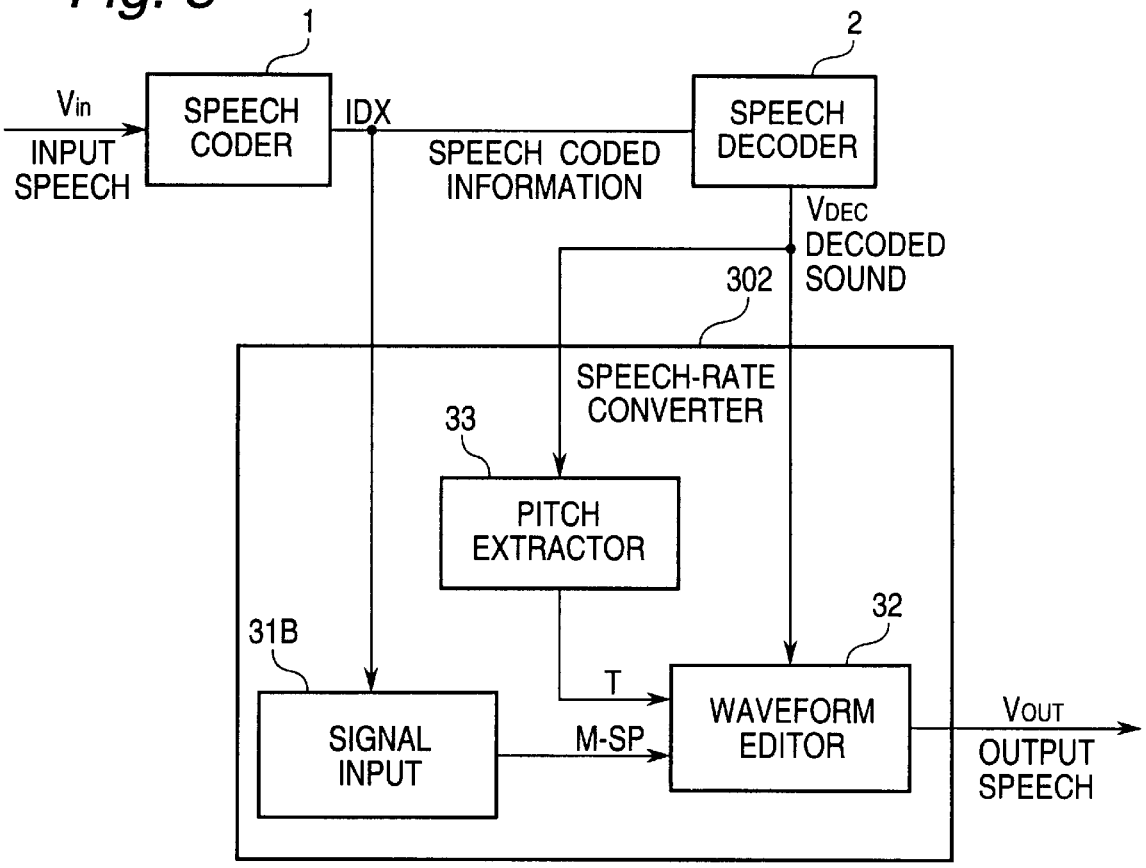
FIG. 8 is a block diagram illustrating a third embodiment of the speech reproducing system in accordance with the present invention.

Next, a third embodiment of the speech reproducing system in accordance with the present invention will be described with reference to FIG. 8. In FIG. 8, elements similar to those shown in FIGS. 4, 6 and 7 are given the same Reference Numerals, and therefore, explanation thereof will be omitted for simplification of the description.

The shown third embodiment includes the speech coder 1 which is the same as the speech coder 10 shown in FIG. 1, the speech decoder 2 which is the same as the speech coder 20 shown in FIG. 2, and a speech-rate converter 302.

The speech-rate converter 302 includes a signal input unit 31B, the waveform editor 32 and a pitch extractor 33. The signal input unit 31B receives the speech coded information IDX from the speech coder 1 and extracts the mode information M from the speech coded information IDX to supply the mode information M as the speech short-time characteristics information SP to the waveform editor 32. This waveform editor 32 and the pitch extractor 33 are the same as those shown in FIG. 4, and therefore, explanation thereof will be omitted for simplification of the description.

In this third embodiment, the speech-rate converter 301 includes the signal input unit 31B, in place of the speech short-time characteristics discriminator 34 shown in FIG. 4, and the signal input unit 31A supplies the mode information M to the waveform editor 32, in place of the speech short-time characteristics information SP. Therefore, the third embodiment can reduce the amount of computation and the deterioration of the precision by the amount corresponding to the speech short-time characteristics discriminator 34 shown in FIG. 4.

As seen from the above, the first embodiment shown in FIG. 6 can be said to be capable of reducing the amount of computation and the deterioration of the precision by the amount corresponding to the pitch extractor 33 and the speech short-time characteristics discriminator 34 shown in FIG. 4.

The invention has thus been shown and described with reference to the specific embodiments. However, it should be noted that the present invention is in no way limited to the details of the illustrated structures but changes and modifications may be made within the scope of the appended claims.

I claim:

1. A speech reproducing system comprising a speech code receiving an input speech signal to output a speech coded information including a pitch information of the input speech signal and a mode information indicative of a short-time characteristics of the input speech signal, a speech decoder receiving and decoding the speech coded information to generate a decoded speech signal, and a speech-rate converter receiving the pitch information included in the speech coded information and decoded speech signal to convert the speech-rate of the decoded speech signal, by using the pitch information from the speech coded information and the mode information from the decoded speech signal, thereby to generate an output speech signal.

2. A speech reproducing system comprising a speech coder receiving an input speech signal to output a speech coded information including a pitch information of the input speech signal and a mode information indicative of a short-time characteristics of the input speech signal, a speech decoder receiving and decoding the speech coded information to generate a decoded speech signal, and a speech-rate converter receiving the mode information included in the speech coded information and the decoded speech signal to convert the speech-rate of the decoded speech signal by using the mode information from the speech coded information and the pitch information from the decoded speech signal, thereby to generate an output speech signal.

3. A speech reproducing system comprising a speech coder receiving an input speech signal to output a speech coded information including a pitch information of the input speech signal and a mode information indicative of a short-time characteristics of the input speech signal, a speech decoder receiving and decoding the speech coded information to generate a decoded speech signal, and a speech-rate converter receiving the pitch information and the mode information included in the speech coded information and the decoded speech signal, the pitch and mode information being received without being decoded by said speech decoder, said speech-rate converter converting the speech-rate of the decoded speech signal by using the pitch information and the mode information, thereby to generate an output speech signal.

* * * * *